US011729543B2

(12) United States Patent
Bang et al.

(10) Patent No.: US 11,729,543 B2
(45) Date of Patent: Aug. 15, 2023

(54) SILICONE WATERPROOF STRUCTURE OF HEADSET

(71) Applicant: BUJEON CO., LTD., Ansan-si (KR)

(72) Inventors: ki-bum Bang, Hwaseong-si (KR); Sunwoo Park, Ansan-si (KR); yong-wook Kwon, Ansan-si (KR)

(73) Assignee: BUJEON CO., LTD., Ansan-si (KR)

( * ) Notice: Subject to any disclaimer, the term of this patent is extended or adjusted under 35 U.S.C. 154(b) by 0 days.

(21) Appl. No.: 17/705,584

(22) Filed: Mar. 28, 2022

(65) Prior Publication Data

US 2022/0321991 A1 Oct. 6, 2022

(30) Foreign Application Priority Data

Apr. 6, 2021 (KR) ..... 10-2021-0044592

(51) Int. Cl.
*H04R 25/00* (2006.01)
*H04R 1/10* (2006.01)

(52) U.S. Cl.
CPC ..... *H04R 1/1058* (2013.01); *H04R 1/1016* (2013.01)

(58) Field of Classification Search
CPC ..... H04R 1/1041; H04R 1/1075; H04R 2460/13; H04R 1/1008; H04R 1/1091; H04R 1/105
See application file for complete search history.

(56) References Cited

U.S. PATENT DOCUMENTS 11,438,685 B2 * 9/2022 Guo ..... H04R 1/1016
2021/0168482 A1 * 6/2021 Wang ..... H04R 1/06

FOREIGN PATENT DOCUMENTS

| | | | |
|---|---|---|---|
| JP | 2011-082701 | A | 4/2011 |
| KR | 10-2014-0033219 | A | 3/2014 |
| KR | 10-1936918 | B1 | 1/2019 |
| KR | 10-2090629 | B1 | 3/2020 |

* cited by examiner

*Primary Examiner* — Amir H Etesam
(74) *Attorney, Agent, or Firm* — KORUS Patent, LLC; Seong Il Jeong

(57) ABSTRACT

The present invention provides a headset with a waterproof structure having an external appearance formed by a front housing having a cap shape and a rear housing that decreases in volume as it goes down and is formed with a sound emitting part at an outlet, the headset comprising: the front housing coupled to the rear housing in an inclined state to one side with respect to a horizontal line; the rear housing accommodating a bracket in an upper portion thereof; the bracket including a first long sidewall and a second short sidewall that extend to boundaries of the front and rear housing, respectively, and a sealing member mounted at a boundary portion between the front and the rear housing and the bracket, wherein the sealing member is made of a flexible plastic resin or a silicone material, with elasticity.

4 Claims, 9 Drawing Sheets

SILICONE WATERPROOF STRUCTURE OF HEADSET

FIELD OF THE INVENTION

The present invention relates to a silicone waterproof structure of a headset.

BACKGROUND OF THE INVENTION

When an audio equipment is exposed to water, including moisture, it may adversely affect its electronic device and cause damage to its parts and deterioration of functions. However, since the audio equipment must have a structure that communicates with outside air, such as a sound emitting hole for communicating with the outside or a high-pressure sound emitting groove for preventing formation of high pressure, it is inevitable that water enters into the inside of the audio equipment through this structure. Accordingly, a waterproof structure, such as a structure providing a waterproof path that can communicate with a frame surrounding a microspeaker around a device's driver, is adopted to manufacture the audio equipment.

Recently, in the process of developing a headset with latest specifications in addition to the microspeaker, the adoption of a waterproof structure has become an important issue. In forming a waterproof structure, it is important to provide a path to discharge water in preparation for entrance of water, but it is more important to hermetically seal the remaining parts except for the part that should communicate with the outside air due to the characteristics of the audio equipment development process.

Among patent documents related to a headset, Korean Patent No. 10-1936918 discloses a VR headset that uses a plurality of flaps to seal the inner wall. Korean Patent No. 10-2090629, as shown in FIG. 6, discloses a structure that comprises a case including a first case body 101', a second case body 102', and a sealing member 105' installed between a rib 113' of the first case body 101' and a side of a speaker body 141'. Here, a reference number 151' denotes an acoustic waveguide. However, since the sealing member 105' is disposed outside the speaker body 141', there is a limit to reducing the size of the entire audio equipment including the case, and the waterproof effect is not guaranteed.

Recently, according to the development of TWS, it is important for headsets to save space and reduce an overall height. Therefore, it is necessary to introduce a new waterproof structure of a headset that utilizes space as efficiently as possible, has an excellent waterproof function, and can be conveniently manufactured, without sacrificing functions.

DETAILED DESCRIPTION OF THE INVENTION

Technical Problems

The object of the present invention is to provide an improved waterproof structure and a headset having the same, which is disposed in an inner space formed by a housing so as not to occupy or expose the space of the headset unnecessarily, and to ensure a waterproof effect by using the advantages of an insert injection process.

SUMMARY OF THE INVENTION

To achieve the objects described above, the present invention provides a headset with a waterproof structure having an external appearance formed by a front housing having a cap shape and a rear housing that decreases in volume as it goes down and is formed with a sound emitting part at an outlet, the headset comprising: the front housing coupled to the rear housing in an inclined state to one side with respect to a horizontal line; the rear housing accommodating a bracket in an upper portion thereof; the bracket including a first sidewall that is a long sidewall and extends to a boundary of the front and rear housing, and a second sidewall that is a short sidewall and extends to a boundary of the front and rear housing, and a sealing member mounted at a boundary portion between the front housing and the bracket and between the rear housing and the bracket, wherein the sealing member is made of a flexible plastic resin or a silicone material, with elasticity.

A lower portion of a sidewall of the front housing may include: a first lower portion; a second lower portion continuously extending upwardly from the first lower portion, and a lower contact surface extending inward from one end of the second lower portion and pressurizing the sealing member from above, wherein an upper portion of a sidewall of the rear housing includes: an upper surface in contact with the first lower portion and a first upper portion extending upward continuously from the upper surface and provided with a groove cut on an inner surface thereof, wherein upper surfaces of the first and the second sidewall of the bracket face and are spaced apart from the lower contact surface and pressurize the sealing member from below, wherein the sealing member is integrally molded with a relatively flat body and an insert formed on an outer surface of the body and having a height greater than that of the body, the insert is inserted in the groove of the first upper portion of the rear housing, and when the front housing is coupled to the rear housing, the lower contact surface of the front housing pushes to pressurize and form a close contact with an upper portion of the insert, and the compressed insert completely seals the front and rear housing.

A lower portion of the sidewall of the front housing may include: a first lower portion; a second lower portion continuously extending upwardly from the first lower portion, and a lower contact surface extending inward from one end of the second lower portion and pressurizing the sealing member from above, wherein a groove is formed on the lower contact surface, wherein an upper portion of a sidewall of the rear housing includes: an upper surface in contact with the first lower portion and a first upper portion extending upward continuously from the upper surface, wherein upper surfaces of the first and the second sidewall of the bracket face and are spaced apart from the lower contact surface and pressurize the sealing member from below, wherein the sealing member is integrally molded with a relatively flat body and an insert formed on an outer surface of the body and having a height greater than that of the body, the insert is inserted in the groove of the lower contact surface of the front housing, and when the rear housing is coupled to the front housing, the upper surface of the first upper portion of the rear housing pushes to pressurize and form a close contact with a lower portion of the insert, and the compressed insert completely seals the front and rear housing.

A lower portion of a sidewall of the front housing may include: a first lower portion and a second lower portion continuously extending upwardly from the first lower portion, wherein an inclined surface that pressurizes the sealing member from outside is formed on an inner side of the first lower portion, wherein an upper portion of a sidewall of the rear housing includes: an upper surface in contact with the first lower portion and a first upper portion extending upward continuously from the upper surface, wherein an outer surface of an inwardly concave portion of the first upper portion pressurizes the sealing member from inside, wherein the sealing member is not in contact with the bracket.

Technical Effects of the Invention

According to the present invention, a design degree of freedom can be increased by determining a molding position and a shape of the insert of the sealing member according to a mounting position of the sealing member made of a flexible silicone material. In addition, since the sealing member can be pressurized by being in close contact with a support member such as the bracket as well as the housing, the present invention has an excellent waterproof effect. Furthermore, since the sealing member can be integrally formed along with the housing by applying it to any of insert molding processes of the housings, the manufacturing process can be convenient and economical, and a strong and durable waterproof structure can be embodied.

DETAILED DESCRIPTION

Objects and technical effects of the present invention, and technical configurations for achieving them will become clear with reference to the embodiments described in detail later in conjunction with the accompanying drawings. In describing the present invention, if a detailed description of a known function or configuration may unnecessarily obscure the gist of the present invention, the detailed description thereof will be omitted.

Throughout the entire specification, when a part "includes" a component or an element, it does not exclude other components or elements unless otherwise stated and means that it may further include other components or elements. Meanwhile, in an embodiment of the present invention, each of the components, functional blocks or means may be composed of one or more sub-components or sub-elements.

Figure 1:
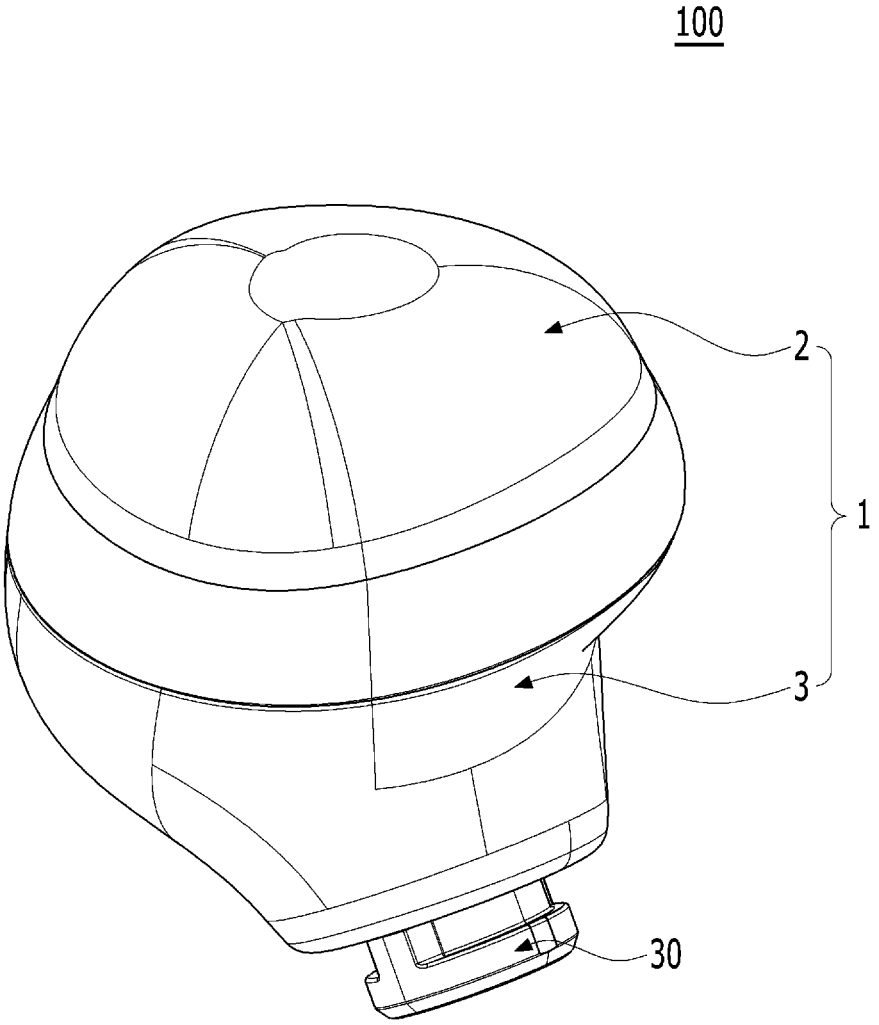
FIG. 1 is a perspective view of an overall external appearance of a headset to which a waterproof structure of the present invention is applied.

FIG. 1 is a perspective view of an overall external appearance of a headset 100 to which a waterproof structure of the present invention is applied. The headset 100 is formed with a housing 1 including a front housing 2 having a cap shape and a rear housing 3 that decreases in volume as it goes down and has a sound emitting part 30 formed at an outlet thereof.

Figure 2:
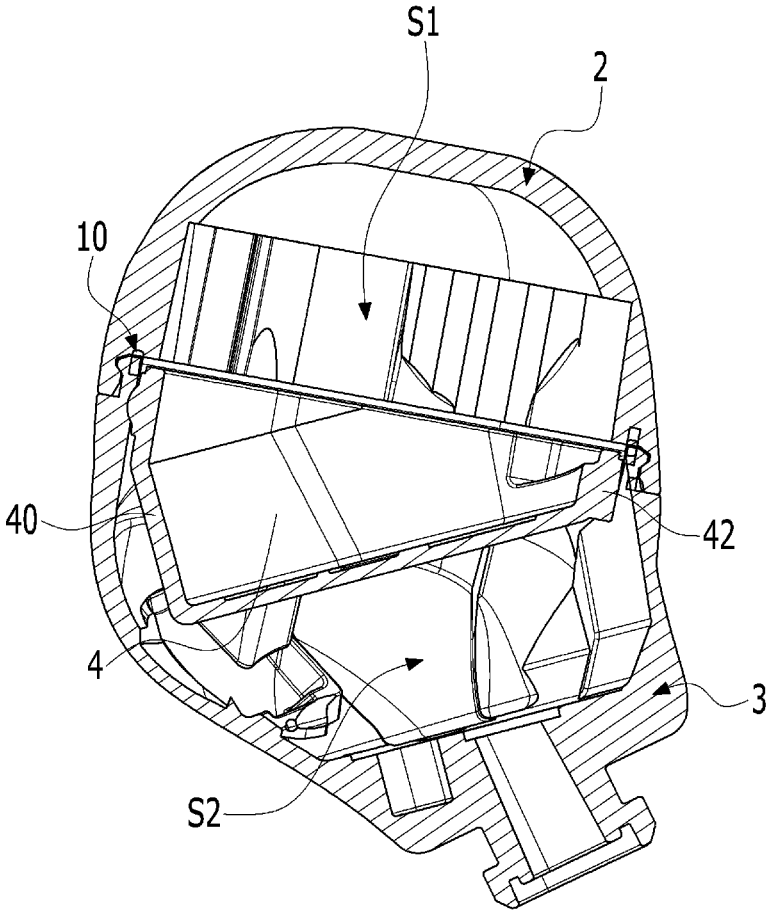
FIG. 2 is an internal cross-sectional view cut along a center of the headset of FIG. 1.

FIG. 2 is an internal cross-sectional view cut along a center of the headset 100 of FIG. 1. The front housing 2 is coupled to the rear housing 3 in an inclined state to one side, for example, to the right side, with respect to a horizontal line. A bracket 4 is accommodated in an upper portion of the rear housing 3. A bottom surface of the bracket 40 is flat, and a first sidewall 40 of the bracket 40 is relatively long and extends to a boundary of the front and rear housing 2, 3. In addition, a second sidewall 42 of the bracket 40 is relatively short and extends to a boundary of the front and rear housing 2, 3. Top ends of the first and second sidewall 40, 42 of the bracket 40 form a boundary between the front and rear housing 2, 3, and the bracket 40 provides an open space inside. Since the front and rear housing 2, 3 are coupled with an inclined surface as a boundary, water including moisture is more likely to enter into the inside of the headset from the outside, compared to a structure in which the two members are horizontally coupled. Accordingly, a sealing structure including a sealing member 10 in the present invention is required.

The sealing member 10 of the present invention is mounted at the boundary between the front housing 2 and the bracket 4 and between the rear housing 3 and the bracket 4. In this case, the sealing member 10 may be mounted in various ways depending on a shape and a structure of these members. The sealing member 10 may be made of a flexible plastic resin or rubber with elasticity, and most preferably a silicone material with high elasticity. The sealing member 10 is manufactured in a circular or annular shape to prevent moisture from penetrating a boundary of edges of the front and rear housing 2, 3. As described below, the sealing member 10 is not coupled to the housing 1 through a bonding or a fusion process but is conveniently manufactured along with either one of the two housings through an insert injection molding process. This process can effectively shorten the manufacturing time and reduce the cost.

In a space S1 provided by the front housing 2, circuit components (not shown) are mounted, and in a space S2 provided by the rear housing 3, acoustic components (not shown) are mounted. The acoustic components include a magnet, a yoke, a voice coil, and a diaphragm, which constitute a driving unit of the headset 100. The bracket 4 serves to firmly hold and support sidewalls of the housing 1, and other components, circuits, or boards, which are associated with the circuit components or the acoustic components, are mounted in an inner space of the bracket 4.

Figure 3A:
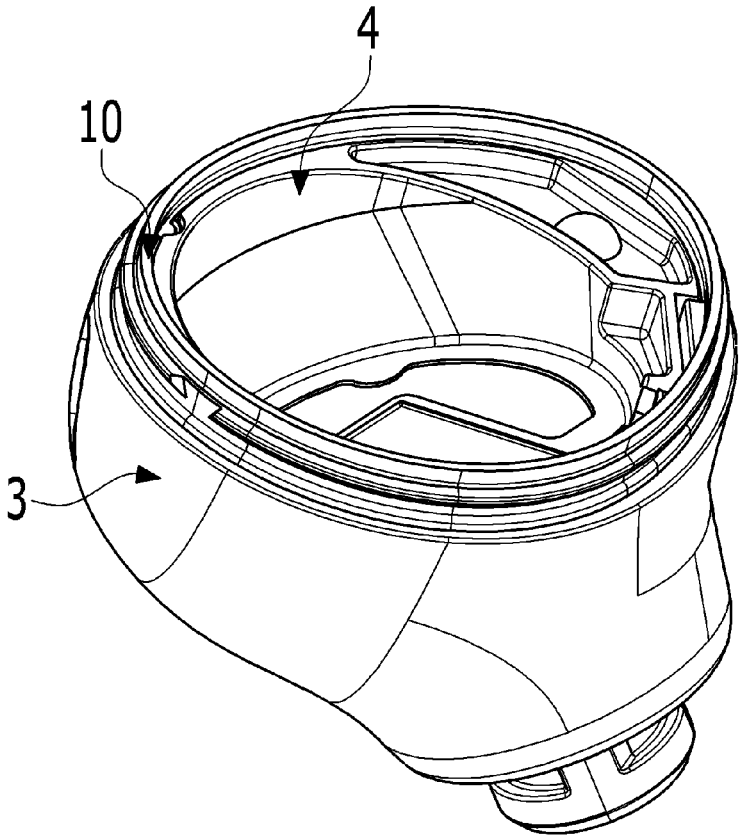
FIG. 3A is a perspective view of a waterproof structure as a first embodiment of the present invention in a state of removing a front housing.
Figure 3B:
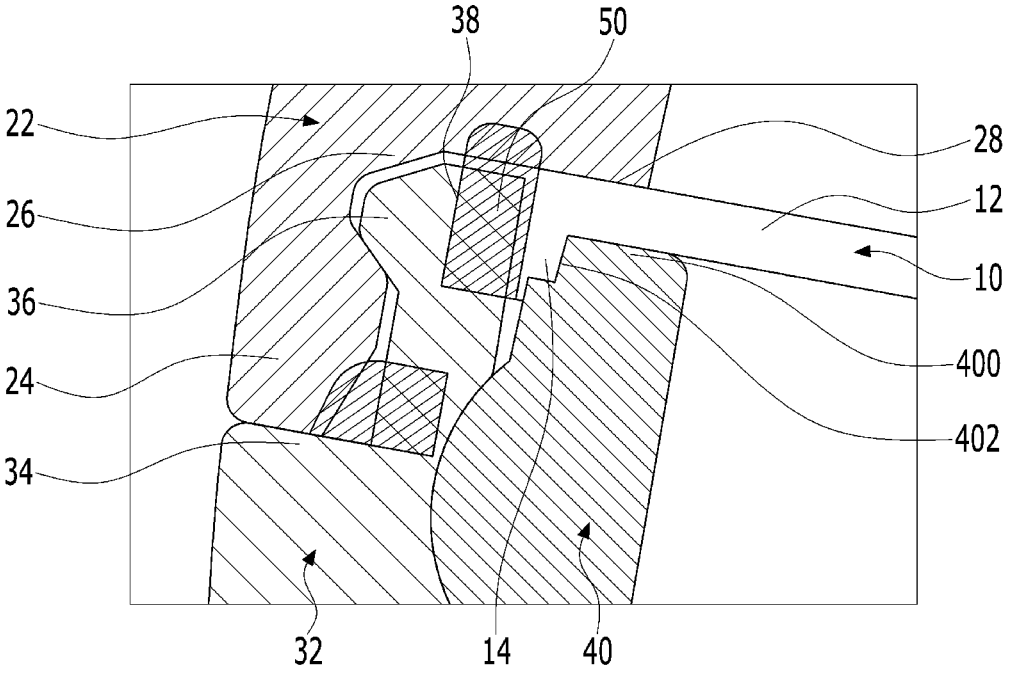
FIG. 3B is a magnified cross-sectional view of a portion where a sealing member is mounted, based on FIG. 3A.

FIGS. 3A and 3B illustrate a first embodiment of the present invention in which the sealing member 10 is mainly mounted on the rear housing 3. FIG. 3A is a perspective view of a waterproof structure in a state of removing the front housing 2, and FIG. 3B is a magnified cross-sectional view of a portion where the sealing member 10 is mounted.

Referring to the two drawings together, first, a lower portion of a sidewall 22 of the front housing 2 includes: a first lower portion 24 that is the lowermost of the front housing 2; a second lower portion 26 continuously extending upwardly from the first lower portion 24, and a lower contact surface 28 extending flatly inward from one end of the second lower portion 26. A protrusion is formed to slightly protrude inward on an inner side of the first lower portion 24, and a concave groove is formed to slightly protrude outward on an inner side of the second lower portion 26. The lower contact surface 28 pressurizes the sealing member 10 from above as shown in FIG. 3B.

An upper portion of a sidewall 32 of the rear housing 3 includes: an upper surface 34 in contact with the first lower portion 24 and a first upper portion 36 extending upward continuously from the upper surface 34 and having a concave groove with which the protrusion of the first lower portion 24 engages and a protrusion to be engaged with the concave groove of the second lower portion 26. A slightly tall groove 38 cut in a square shape is formed on an inner surface of the first upper portion 36. The protrusions and concave grooves of the front housing 2 and the rear housing 3 have shapes that are complementary to each other, and thus, when the two members engage with each other, they increase a clamping force and perform a waterproof function.

The sidewall 40 of the bracket 4 is disposed inside the rear housing 3. An upper surface 400 of the sidewall 40 faces and is spaced apart from the lower contact surface 28 of the upper housing 2 and pressurizes the sealing member 10 from below. The upper surface 400 of the sidewall 40 includes an outer stepped portion 402. Since the other sidewall 42 also has the same structure as the sidewall 40, the sidewall 40 will be described as a reference.

The sealing member 10 of the present invention includes a relatively flat body 12 and a flange 14 bent downward from one end of the body 12. An edge portion of the sealing member 10 is interposed among the lower contact surface 28 of the upper housing 2, and the upper surface 400 and the stepped portion 402 of the bracket 4 and maintain an airtight state with the outside.

As described above, for insert-molding the sealing member 10 along with the housing 2,3 according to the present invention, a portion where the sealing member 10 can be hung is spared inside a mold, the remaining inner space of the mold is manufactured in the same shape as the rear housing 3, and then plastic resin is filled in the latter space to integrally injection-mold the sealing member 10 along with the rear housing 3. In the present invention, an insert 50 having a height greater than that of the body 12 of the sealing member 10 is integrally formed on an outer surface of the sealing member 10. Since the insert 50 is caught in the mold corresponding a portion where the groove 38 of the rear housing 3 is to be formed during the injection molding, the insert 50 stably supports the sealing member 10 so that the position of the sealing member 10 does not change. In particular, in the present invention, when the front housing 2 is coupled to the rear housing 3 in the later process, the lower contact surface 28 of the front housing 2 pushes to pressurize and form a close contact with an upper portion of the insert 50 and is closely coupled to the rear housing 3, and the compressed insert 50 can substantially completely seal the two housings 2, 3. As described above, the sealing member 10 of the present invention has another feature in that advantages of the injection molding process are reflected in the sealing structure as much as possible.

Figure 4A:
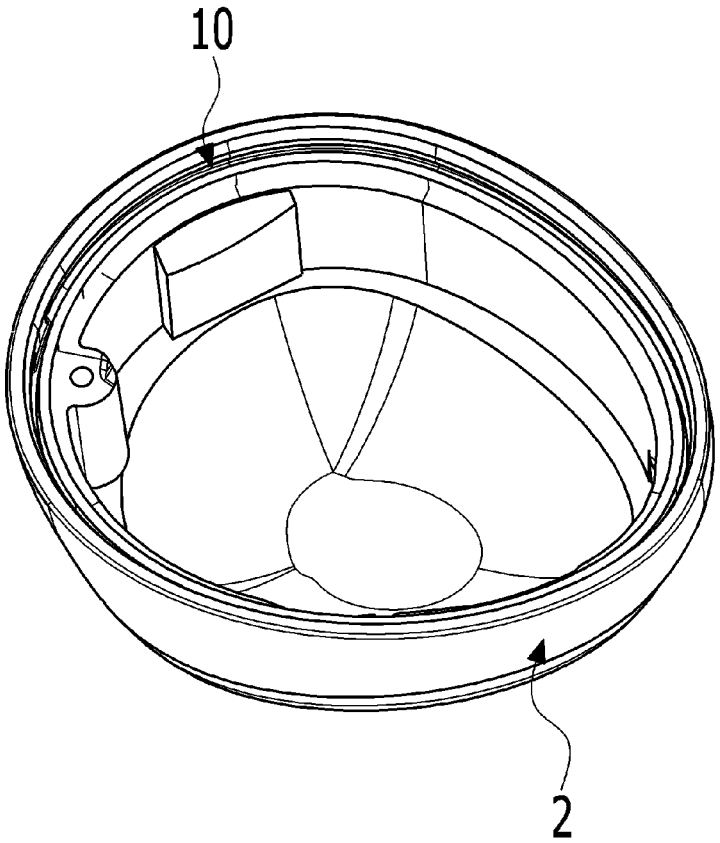
FIG. 4A is a perspective view of a waterproof structure of a second embodiment of the present invention in a state of removing a rear housing.
Figure 4B:
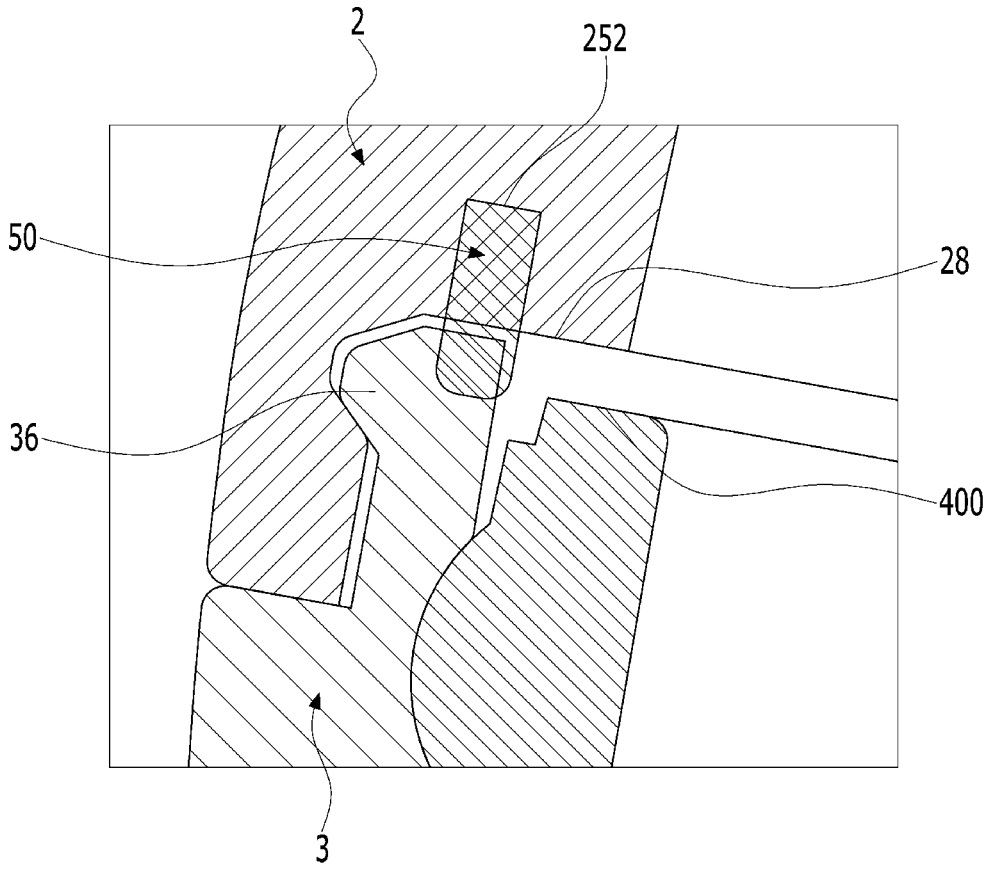
FIG. 4B is a magnified cross-sectional view of a portion where a sealing member is mounted, based on FIG. 4A.

FIGS. 4A and 4B illustrate a second embodiment of the present invention in which the sealing member 10 is mainly mounted on the front housing 2, as opposed to the first embodiment. FIG. 4A is a perspective view of a waterproof structure in a state of removing the rear housing 3, and FIG. 4B is a magnified cross-sectional view of a portion where the sealing member 10 is mounted.

In descriptions of the second embodiment, parts identical to or slightly different from those in the embodiment described above will be omitted so as not to obscure the gist of the present invention.

In the second embodiment, a slightly tall groove 252 cut in a square shape is formed on the lower contact surface 28 of the front housing 2. An edge portion of the sealing member 10 is interposed between the lower contact surface 28 and the upper surface 400 of the bracket 4 to maintain an airtight state with the outside.

In the case of the second embodiment, a portion where the sealing member 10 can be hung is spared inside a mold, the remaining inner space of the mold is manufactured in the same shape as the front housing 2, and then plastic resin is filled in the latter space to integrally injection-mold the sealing member 10 along with the front housing 2. Similarly to the previous embodiment, the insert 50 having a height greater than that of the body 12 of the sealing member 10 is integrally formed on an outer surface of the sealing member 10. Since the insert 50 is caught in the mold corresponding a portion where the groove 252 of the front housing 2 is to be formed during the injection molding, the insert 50 stably supports the sealing member 10 so that the position of the sealing member 10 does not change. In addition, in the present invention, when the rear housing 3 is coupled to the front housing 2 in the later process, an upper surface of the first upper portion 36 of the rear housing 3 pushes to pressurize and form a close contact with an lower portion of the insert 50 and is closely coupled to the front housing 2, and the compressed insert 50 can substantially completely seal between the two housings 2, 3. As described above, the sealing member 10 of the present invention has another feature in that advantages of the injection molding process are reflected in the sealing structure as much as possible. Accordingly, the second embodiment also has a reliable sealing effect as in the first embodiment.

Figure 5A:
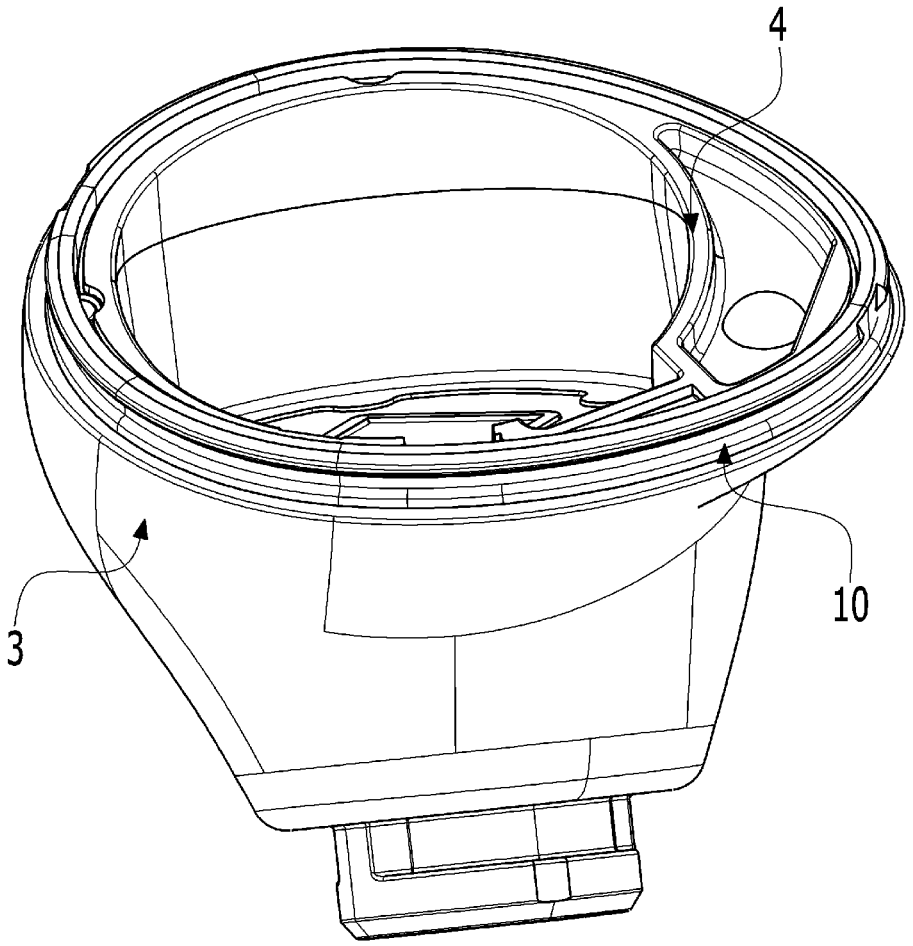
FIG. 5A is a perspective view of a waterproof structure of a third embodiment of the present invention in a state of removing a front housing.
Figure 5B:
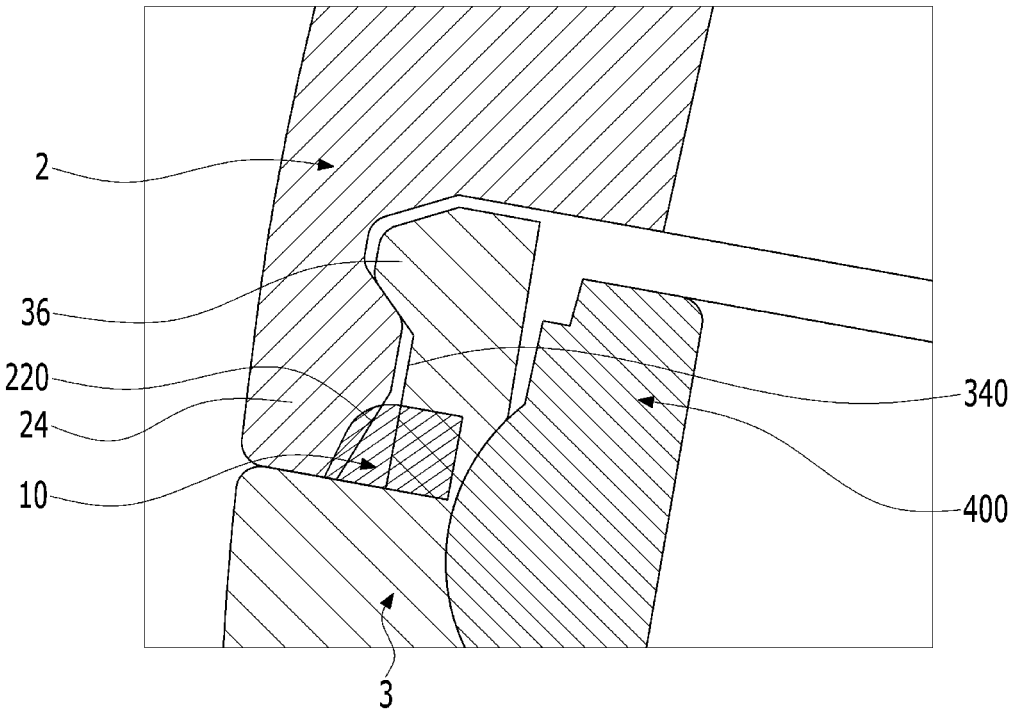
FIG. 5B is a magnified cross-sectional view of a portion where a sealing member is mounted, based on FIG. 5A.
Figure 6:
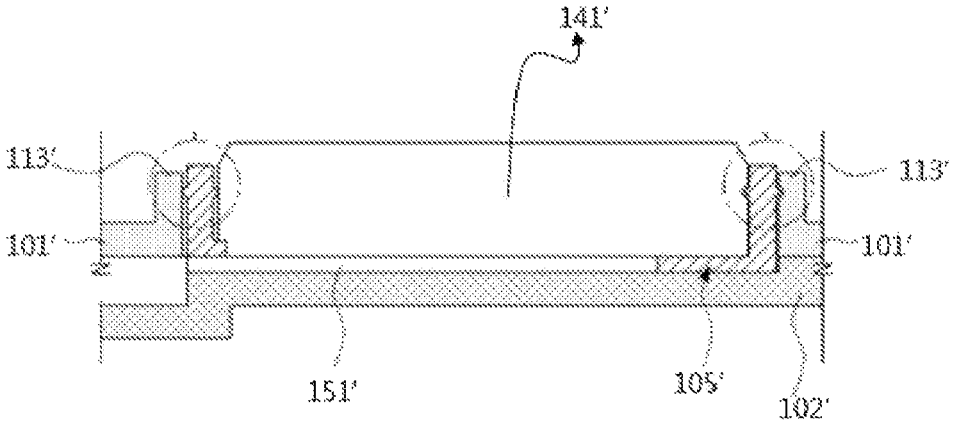
FIG. 6 is a drawing illustrating an example of a sealing member of a headset of the prior art.

FIGS. 5A and 3B illustrate a third embodiment of the present invention in which the sealing member 10 is disposed on a further outer side of the rear housing 3 and is interposed only between the front housing 2 and the rear housing 3 without being interfered with the bracket 4. FIG. 5A is a perspective view of a waterproof structure in a state of removing the front housing 2, and FIG. 5B is a magnified cross-sectional view of a portion where the sealing member 10 is mounted.

In descriptions of the third embodiment, parts identical to or slightly different from those in the embodiment described above will be omitted so as not to obscure the gist of the present invention.

In the third embodiment, a protrusion is not formed on the first lower portion 24 of the front housing 2, but an inclined surface 220 that pressurizes the sealing member 10 is formed instead. Corresponding to the inclined surface 220, an outer surface 340 of an inwardly concave portion of the first upper portion 36 of the rear housing 3 is manufactured to be higher than that of the first embodiment to accommodate the sealing member 10. The upper surface 34 and the outer surface 340 of the rear housing 3 are manufactured to be perpendicular to each other to pressurize the sealing member 10 toward the inclined surface 220, but the scope of the present invention is not limited thereto.

In the case of the third embodiment, it is possible to integrally mold the insert 50 along with the housing 1 as in the previous embodiment. However, since the sealing member 10 is mounted on the further outer portion of the housings 2, 3, if a groove for accommodating the insert is formed, a force may be concentrated on a portion where the housing pushes the insert, and this makes it difficult to assemble the front and rear housing 2,3. In this case, the insert 50 may be deleted.

As described above, according to the present invention, a design degree of freedom can be increased by determining whether to mold the insert 50 according to a mounting position of the sealing member 10, such as the outer side or the inner side of the housing 1.

As described above, the preferred embodiment of the present invention has been described, but the waterproof structure of the present invention is particularly suitable for a headset or headphone with an inclined-coupled housing in which water enters easily. In addition, since the sealing member can be pressurized by being in close contact with a support member such as the bracket as well as the housing, the present invention has an excellent waterproof effect. Furthermore, since the sealing member can be integrally formed along with the housing by applying to any of insert molding process of housings, the manufacturing process can be convenient and economical, and a strong and durable waterproof structure can be embodied.

What is claimed is:

1. A headset with a waterproof structure having an external appearance formed by a front housing having a cap shape and a rear housing that decreases in volume as it goes down and is formed with a sound emitting part at an outlet, the headset comprising:

the front housing coupled to the rear housing in an inclined state to one side with respect to a horizontal line;

the rear housing accommodating a bracket in an upper portion thereof;

the bracket including a first sidewall that is a long sidewall and extends to a boundary of the front and rear housing, and a second sidewall that is a short sidewall and extends to a boundary of the front and rear housing, and a sealing member mounted at a boundary portion between the front housing and the bracket and between the rear housing and the bracket, wherein the sealing member is made of a flexible plastic resin or a silicone material, with elasticity.

2. The headset with a waterproof structure of claim 1, wherein a lower portion of a sidewall of the front housing includes: a first lower portion; a second lower portion continuously extending upwardly from the first lower portion, and a lower contact surface extending inward from one end of the second lower portion and pressurizing the sealing member from above, wherein an upper portion of a sidewall of the rear housing includes: an upper surface in contact with the first lower portion and a first upper portion extending upward continuously from the upper surface and provided with a groove cut on an inner surface thereof, wherein upper surfaces of the first and the second sidewall of the bracket face and are spaced apart from the lower contact surface and pressurize the sealing member from below, wherein the sealing member is integrally molded with a relatively flat body and an insert formed on an outer surface of the body and having a height greater than that of the body, the insert is inserted in the groove of the first upper portion of the rear housing, and when the front housing is coupled to the rear housing, the lower contact surface of the front housing pushes to pressurize and form a close contact with an upper portion of the insert, and the compressed insert completely seals the front and rear housing.

3. The headset with a waterproof structure of claim 1, wherein a lower portion of the sidewall of the front housing includes: a first lower portion; a second lower portion continuously extending upwardly from the first lower portion, and a lower contact surface extending inward from one end of the second lower portion and pressurizing the sealing member from above, wherein a groove is formed on the lower contact surface, wherein an upper portion of a sidewall of the rear housing includes: an upper surface in contact with the first lower portion and a first upper portion extending upward continuously from the upper surface, wherein upper surfaces of the first and the second sidewall of the bracket face and are spaced apart from the lower contact surface and pressurize the sealing member from below, wherein the sealing member is integrally molded with a relatively flat body and an insert formed on an outer surface of the body and having a height greater than that of the body, the insert is inserted in the groove of the lower contact surface of the front housing, and when the rear housing is coupled to the front housing, the upper surface of the first upper portion of the rear housing pushes to pressurize and form a close contact with a lower portion of the insert, and the compressed insert completely seals the front and rear housing.

4. The headset with a waterproof structure of claim 1, wherein a lower portion of a sidewall of the front housing includes: a first lower portion and a second lower portion continuously extending upwardly from the first lower portion, wherein an inclined surface that pressurizes the sealing member from outside is formed on an inner side of the first lower portion, wherein an upper portion of a sidewall of the rear housing includes: an upper surface in contact with the first lower portion and a first upper portion extending upward continuously from the upper surface, wherein an outer surface of an inwardly concave portion of the first upper portion pressurizes the sealing member from inside, wherein the sealing member is not in contact with the bracket.

* * * * *